US005975576A

United States Patent [19]

Vogel

[11] Patent Number: 5,975,576

[45] Date of Patent: Nov. 2, 1999

[54] FILE WITH A MODULAR CONSTRUCTION

[76] Inventor: Jurgen Vogel, Im Pfostenwaldle 11, Stuttgart, D-70451, Germany

[21] Appl. No.: 09/202,520

[22] PCT Filed: Jul. 19, 1996

[86] PCT No.: PCT/EP96/02643

§ 371 Date: Dec. 16, 1998

§ 102(e) Date: Dec. 16, 1998

[87] PCT Pub. No.: WO97/48564

PCT Pub. Date: Dec. 24, 1997

[51] Int. Cl.[6] ..... B42D 1/00

[52] U.S. Cl. ..... 281/16

[58] Field of Search ..... 281/15.1, 16, 21.1, 281/27.1, 29, 36, 37, 45; 402/70, 73, 75, 76, 78

[56] References Cited

U.S. PATENT DOCUMENTS

| | | | |
|---|---|---|---|
| 2,233,898 | 3/1941 | Pitt et al. | 129/1 |
| 3,275,343 | 9/1966 | Holm | 281/16 |
| 3,620,552 | 11/1971 | Woodcock | 281/16 X |
| 3,837,680 | 9/1974 | Cimini | 281/16 |
| 4,943,177 | 7/1990 | Jordan et al. . | |

FOREIGN PATENT DOCUMENTS

| | | | |
|---|---|---|---|
| 93 01 485 U | 4/1993 | Germany | B42F 13/00 |
| 43 39 929 | 12/1994 | Germany | B42F 13/16 |

*Primary Examiner*—Willmon Fridie, Jr.
*Attorney, Agent, or Firm*—McCormick, Paulding & Huber LLP

[57] ABSTRACT

A file with a modular construction, with a back section (1), which laterally comprises a first wing (2) and a second wing (3) arranged pivotably thereon, with a file back (5) releasably connected to the first wing (2) and with a file cover (4) releasably connected to the second wing (3), with a clamp mechanism (71,81) with a first retaining strip (7,8) and with a second retaining strip (6), wherein the file back (5) is releasably held in a clamped manner between the first wing (2) and the first retaining strip (7,8) and the file cover (4).

11 Claims, 3 Drawing Sheets

FILE WITH A MODULAR CONSTRUCTION

FIELD OF THE INVENTION

The invention relates to a file with a modular construction, according to the preamble of the independent patent claim.

BACKGROUND OF THE INVENTION

From DE-U-9301485 there is known a file with a modular construction. It comprises a back section with laterally pivotable wings on the file backs and the file covers can be connected to the wongs by way of slider strip. For this the file covers and file backs comprise a multitude of recesses arranged on a line parallel to the rear edge and arranged at roughly uniform distances. The recesses comprise a rectangular introduction opening and a slot-like extension connecting thereto. The sliders are provided with the same multitude of T-shaped locking elements at the same distances. When the file cover is applied on the corresponding wing, the slider strip is fastened in that its T-shaped locking element with the transverse crosspiece is inserted through the introduction openings and is pulled into the locking slot with the longitudinal arm. The slider strip externally is arranged on the file cover and file back and engages inwardly with the locking element. This is necessary so that on normal use the locking elements are not damaged, since the transverse crosspiece of the T-shaped locking elements project beyond the surface of the cover. The file or clamp mechanism is connected to the back section. This has the effect that for every type of file, according to the width and clamp standard, European or American, a complete back section must be manufactured.

SUMMARY OF THE INVENTION

It is the object of the invention to provide a modularly constructed file which enables the back width, the filing mechanism and the latching device to be adapted to differing file thicknesses and clamp standards in the simplest manner. It is to comprise almost no protruding parts which on normal handling may easily be damaged.

This object is achieved by the invention specified in the patent claims.

The advantages of the invention lie in the fact that each file may be put together exactly according to the desired requirements from a minimal number of differing elements. Each file may also later be adapted in the simplist manner to new requirements and wishes. Each of its elements may be individually exchanged. For example the clamp mechanism or the colour of the file cover or the width of the back section may be changed alone or in a combined manner.

BRIEF DESCRIPTION OF THE DRAWINGS

The file according to the invention is hereinafter described in the context of the drawings. There are shown.

DETAILED DESCRIPTION OF THE PREFERRED EMBODIMENTS

Figure 1:
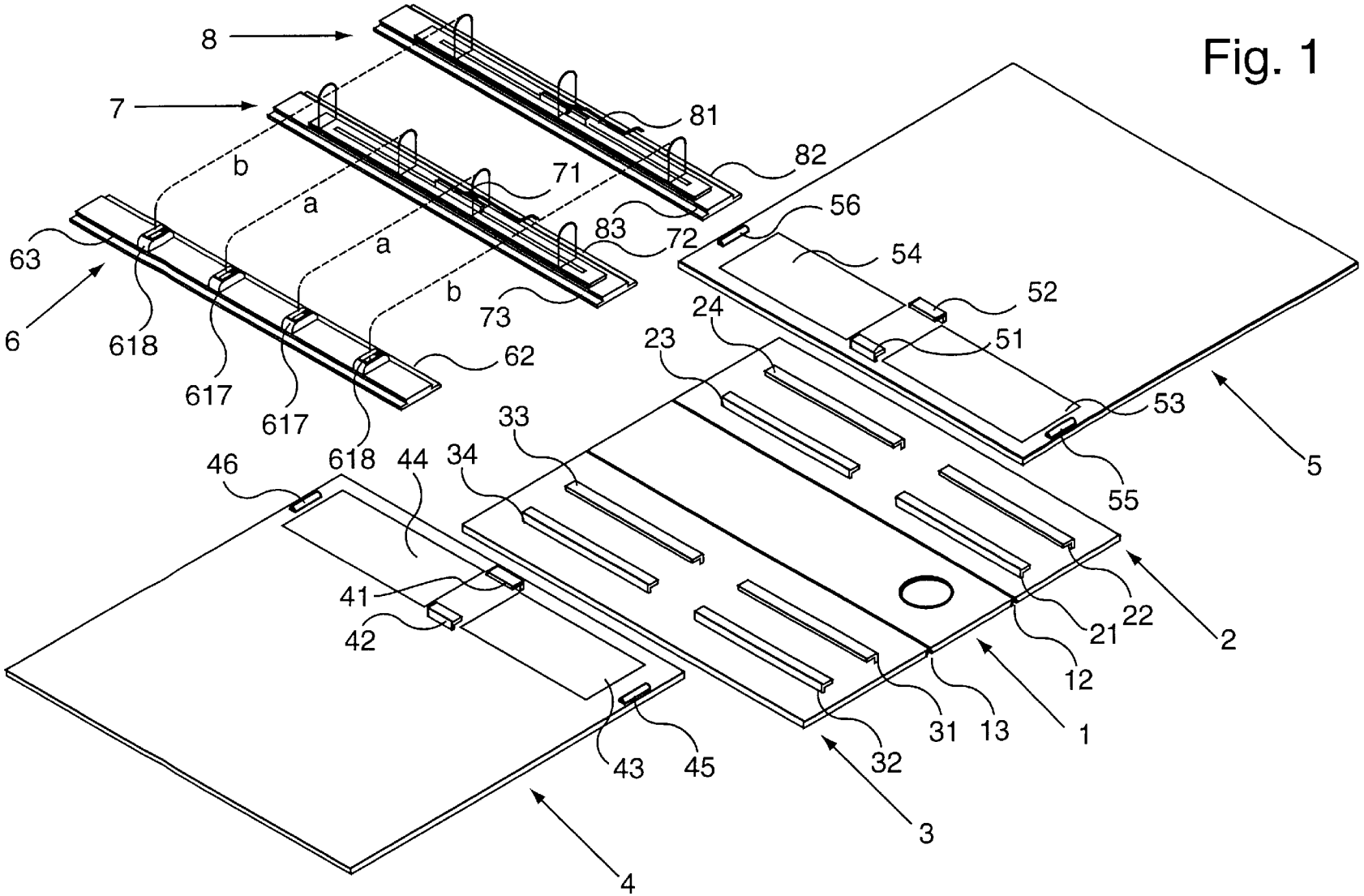
FIG. 1 an exploded drawing of the file.
Figure 2:
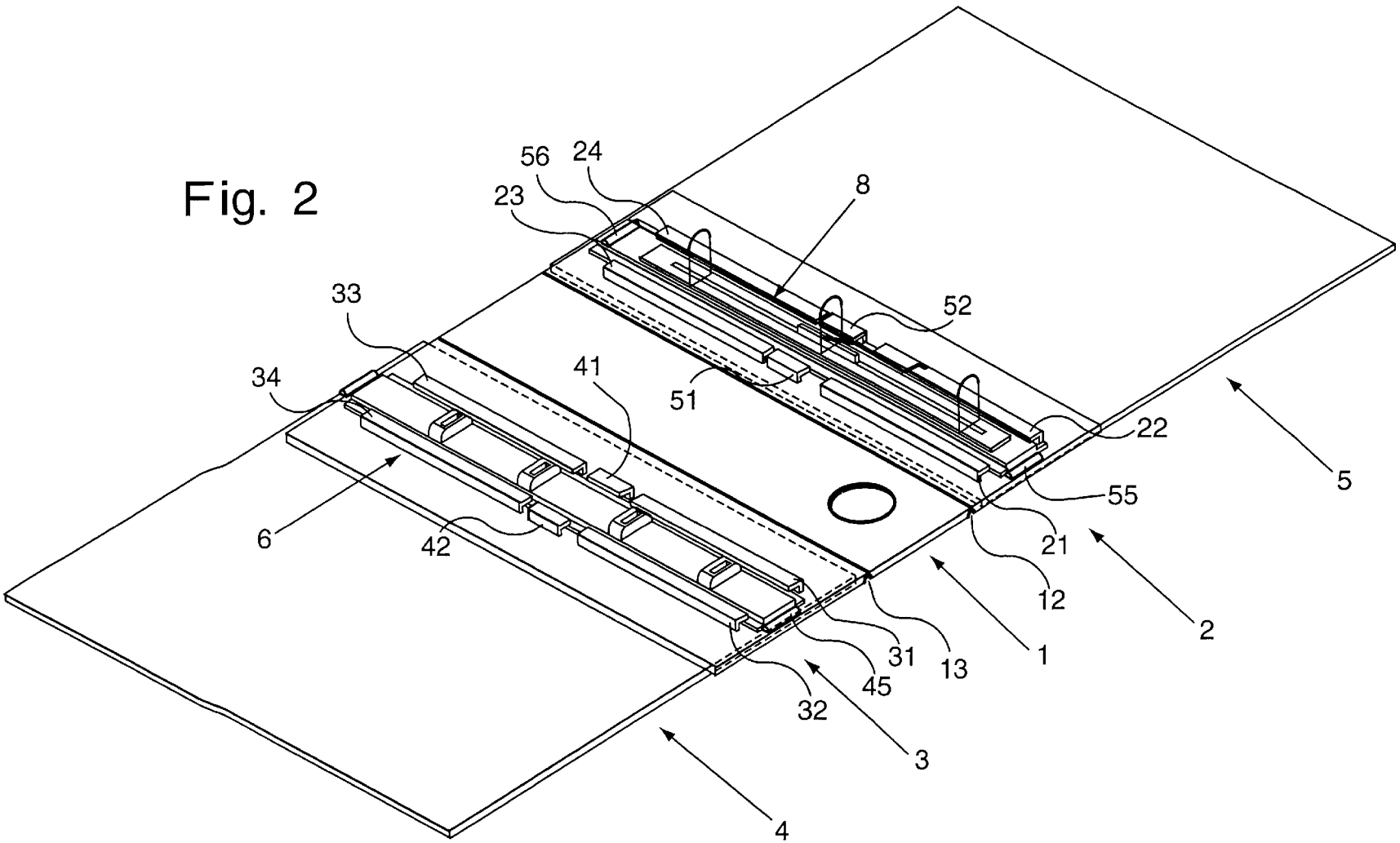
FIG. 2 a representation of the joined together file.
Figure 3:
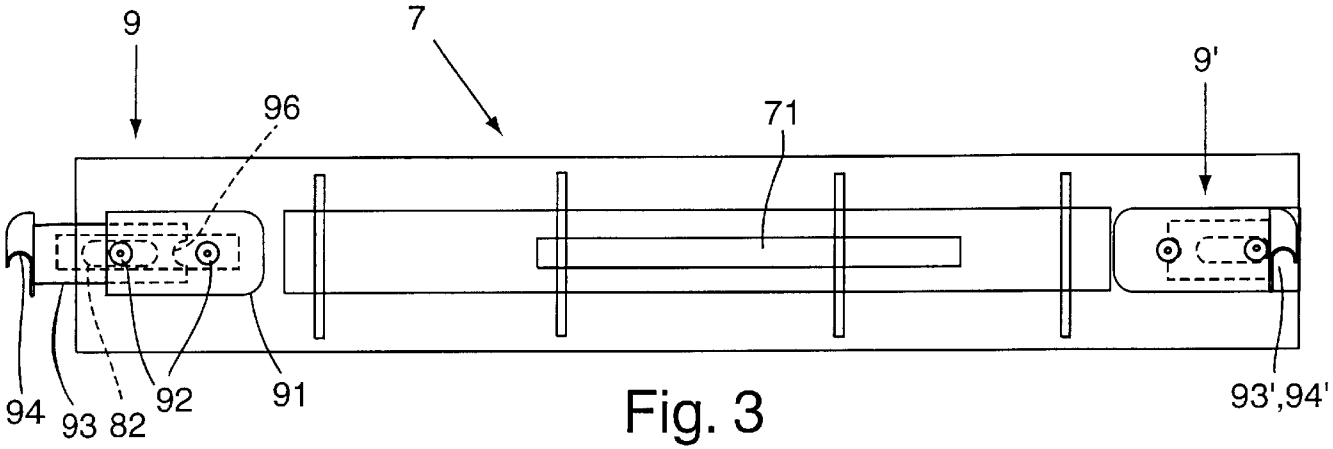
FIG. 3 a view of a retaining strip with the file mechanism and securing elements.

In FIG. 1 all important parts of a file according to the invention are shown in an exploded drawing. The file consists basically of a back section 1 with laterally attached wings 2, 3, a file cover 4, a file back 5, a first retaining strip 7, 8 with a clamp mechanism 71, 81 and a second retaining strip 6.

The back section 1 is pivotably connected with first film-like hinge 12 to the first wing 2 and with a second film-like hinge 13 to the second wing 3. Each wing 2, 3 is provided with at least in each case two L-shaped first guide strips 21–24 and second guide strips 31–34 running parallely opposite one another and distanced. In the shown preferred embodiment form the first wing 2 comprises parallel guide strips in a paired arrangement, and specifically two lower 21, 22 and two upper 23, 24 L-shaped guide strips directed opposing one another. Between the lower 21, 22 and the upper 23, 24 guide strips there exists an intermediate space free of guide strips. The L-shaped guide strips lying opposite one another face opposite one another with the free arm so that between the free arms and the surface of the respective wing 2, 3 there is present a groove-like receiving path for receiving the retaining strips 6–8 described further below.

The file cover 4 and file back 5 correspond to one another in the mirror image. They comprise in the section near to the back section 1 at least in each case one recess 43, 44, 53, 54 which are dimensioned such that the file cover 4 and the file back 5 may be so applied on the wings 3, 2 that the L-shaped guide strips 21–24, 31–34 reach through the recesses 43, 44, 53, 54 and bear on the longitudinal sides of these with their outer flanks. In the preferred embodiment form, as drawn, in the file cover 4 and in the file back 5 there are located in each case two such recesses and specifically in each case an upper recess 44, 54 and in each case a lower recess 45, 53 which corresponds to the arrangement of the guide strips 21–24 and 31–34. Between in each case the upper 44, 54 and the lower 43, 53 recess there are likewise located in each case two opposingly directed L-shaped third guide strips 41, 42 on the file cover 4 and fourth guide strips 51, 52 in the file back 5.

If a file cover 4 with its recesses 43, 44 is applied over the guide strips 31–34 and bears on the surface of the second wing 3, a second retaining strip 6 may be inserted into the groove-like guide path formed by the second guide strips 31–34 of the wing 3 and by the third guide strips 41, 42 of the file cover. The same applies to the file back 5, the wing 2 and a first retaining strip 7, 8 with their corresponding elements.

For this the first retaining strip 7, 8 and the second retaining strip 6 are provided with lateral retaining flanks 72, 73, 82, 83, 62, 63 on their longitudinal sides. The retaining strips have a length which is somewhat smaller than the height of the file. The whole width including the retaining flanks corresponds to the inner distance between the respective guide strips lying opposite one another. Thus the retaining strips on insertion into the receiving paths formed by the guide strips, are guided and in the inserted condition are also retained. Thus then the file cover 4 and the file back 5 are clampingly retained and fixed by the retaining strips bearing on the guide strips, between these retaining strips and the corresponding wings. So that the retaining strips may not unintentionally slide out of their position, after the upper and the lower edge on the inner side of the file cover and of the file back there is in each case located a stop lug 45, 46 and 55, 56. The inserted retaining strips are thus held between in each case the upper and the lower stop lug 45, 46 and 55, 56. They may only be withdrawn again intentionally out of the clamping position between the guide strips with a slight bending back of the file cover 4 and file back 5.

The first retaining strip 7, 8 comprises on both longitudinal sides in each case a retaining flank 72, 73, 82, 83 directed outwardly. The retaining flanks may be formed as shoulders or suitable surfaces. They serve the positive fit and/or non-positive fit connection to the guide strips. On the first retaining strip 7, 8 there is assembled a clamp mechanism 71, 81 of the known type. With this the clamp mechanism 71 corresponds to the European Standards of hole distances with two or with four clamps, as is represented in FIG. 1 with the retaining strip 7. The alternative retaining strip 8 with the clamping mechanism 81 corresponds to the US Standard with three clamps/holes.

The second retaining strips 6 likewise comprises on both longitudinal sides in each case a retaining flank 62, 63 directed outwardly, with the same purpose and the same function as is described above. Instead of a ring mechanism it is provided with clamp receivers 617, 61 8. The clamp receivers are elevations which are provided with a groove open at the top. They are arranged at a distance corresponding to the clamps of the clamp mechanism 71, 81. In the closed condition of a file in each case at least one of the clamps is received in the groove of one of the clamp receivers and held in a lightly clamped manner. By way of this the file in the closed condition obtains the desired stability so that it may be placed upright by itself. In the illustrated embodiment form of the second retaining strip 6 the clamp receivers are arranged such that the first clamp receivers 617 are arranged in the inner region and correspond to the arrangement of clamps with the two-clamped or the inner two clamps of the four-clamped European Standard a. The outer two clamp receivers 618 correspond to b to the outer two clamps of the three-clamped US Standard. This one embodiment form is sufficient for all three commonplace clamp arrangements of files.

A further possibility for the universal application of the file lies in the fact that the first retaining strip 7, 8 is provided with means for hanging up the file in an existing hanging filing cabinet. An advantage of the file according to the invention lies exactly in the fact that the contents of a file with the retaining strip, but without the back section 1, the file cover 4 and file back 5, may be hung up in a hanging filing cabinet without the clamp mechanism having to be opened and the documents having to be taken in the hand. For this on the first retaining strip 7, 8 on the narrow sides 9, 9' there is arranged in each case an insertable hanging-up hoe. The hanging-up hoe 94, 94' is formed at one end of a sliding part 93, 93'. It is displaceably mounted on a retaining rail 91 and comprises sliding guides 95, 96. The retaining rail 91 is simultaneously a cover of the sliding part 93 and is for example fastened to the retaining rail 7, 8 with rivets 92. The rivets 92 may with this serve simultaneously as abutments for limiting the displaceability. In the inserted condition the hanging-up hoes 94, 94' are located within the file completely in the region of the retaining strip 7,8. For hanging up the file only the retaining strips 6 and 7, 8 are withdrawn from the guide strips, whereupon the file is disassembled into its basic elements. With this the documents remain retained unchanged on the clamps of the clamp mechanism 71, 81. Then the hanging-up hoes 94, 94' are withdrawn laterally up to their abutment on the retaining rails 91. Their distance corresponds then exactly to the distance of the frame of a hanging filing cabinet and may be hung in such a filing cabinet without further ado. The first retaining strip 7, 8 hangs in a hanging filing cabinet with a narrow side upwards and the clamps of the clamp mechanism 71, 81 project laterally and thus occupy approximately the space which corresponds to the width of the file.

Figure 4B:
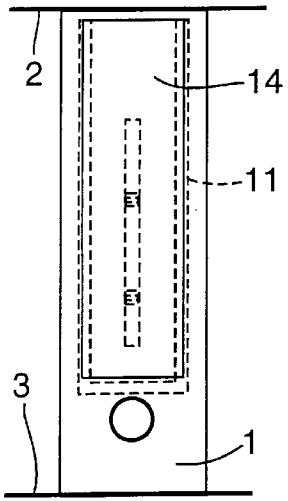
FIGS. 4*a* to *c* show an embodiment form of a back section with an accompanying inscription strip.
Figure 4C:
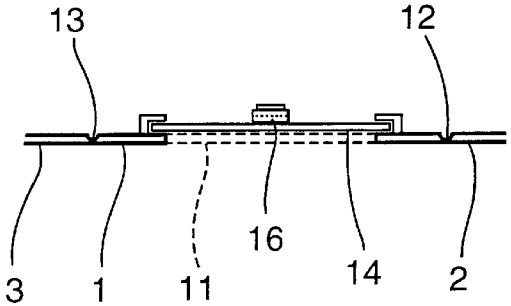
Figure 4A:
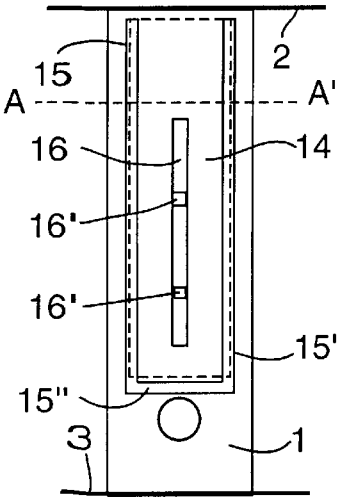

Furthermore inscription strips may be provided which as a protective band are arranged above and below the documents or may serve as an inscription of the back section of the file, also used here without further ado. With this the inscription strips formed as protective bands may be simply pushed laterally on the clamps of the ring mechanism. A preferred embodiment form of these inscription strips and their fastening to the file can be seen from the FIGS. 4*a*–c. With this, FIG. 4*a* shows the file back section from the inside, FIG. 4*b* from the outside and FIG. 4*c* in the cross section A–A' of FIG. 4*a*. The back section 1 of the file, with the wings 2 and 3 which are pivotable thereon by way of the film-like hinges 12 and 13, comprises a cutout which forms a viewing window 11. On the inside of the file the viewing window 11 on its two longitudinal sides and below is bordered by L-shaped guide strips. With this the inner surface of the back section together with the L-shaped guide strips forms receiving grooves in which a inscription strip 14 can be inserted. The inscription strip 14 is thus insertable on the back section and can be withdrawn again, thus can be removed. The inscription strip 14 may be inscribed on one surface. On the opposite surface it is provided with at least two clips 16'. These clips comprise grooves in which the clamps of the clamp mechanism may be lightly clamped. The clips 16' may be fastened to a clip strip 16 of a known type. This inscription strip 14 then on the file fulfills the function of a normal changeable file inscription. If then as described above, the file is disassembled into its elements and the first retaining strip 7,8 with the file contents are hung up in a filing cabinet, then the inscription strip 14 may be pulled out of the back section 1 of the file and with the clips 16' may be stuck onto the clamps of the clamp mechanism 71,81 so that they are held in a slightly clamped manner. In this condition in the filing cabinet the inscription strip 14 is viewable from above and thus the contents of the file may also be identified here without the file having to be additionally inscripted.

The file according to the invention may therefore always be adapted to the quantity of the contents in that with an increasing quantity of content only the first retaining strip 7, 8 and the back section 1 need be exchanged. Thus for example the file cover 4 and the file back 5 according to desire, purpose etc. may for example be provided with the individual colouring of the companies. Each file may be usefully assembled or changed from the few standardised elements in the simplist manner, and for the archiving of the contents in filing cabinets the contents need not be removed and distributed in a newly arranged manner in hanging folders. An adaptation of the external picture of appearance of files to the application or to the company picture may be limited to the special colouring also of only the back section 1 or file cover 4. Since apart from the ring mechanism all elements may consist of relatively thin plastic plates, also always a good quality, life expectancy and perfect stability is ensured. Of course all or individual elements of the file may also consists of another suitable material, such as for example cardboard, wood or aluminium sheet metal.

I claim:

1. A file with a modular construction, with a back section (1), which laterally comprises a first wing (2) and a second wing (3) arranged pivotably thereon, with a file back (5) releasably connected to the first wing (2) and with a file cover (4) releasably connected to the second wing (3), with a clamp mechanism (71,81) with a first retaining strip (7,8) and with a second retaining strip (6), wherein the file back (5) is releasably held in a clamped manner between the first wing (2) and the first retaining strip (7,8) and the file cover (4) is releasably held in a clamped manner between the second wing and the second retaining strip (6), characterised in that the first wing (2) is provided with first guide strips (21–24) which in each case form a free receiving region (25) for receiving the first retaining strip (7, 8), and the file back (5) comprises at least one first window-like recess (53,54) through which the first guide strips (21–24) protrude, and that the second wing (3) is provided with second guide strips (31–34) and the file cover (4) comprises at least one second window-like recess (43,44) and that the first retaining strips project, and that the first retaining strip (7,8) and the second retaining strip (6) comprise retaining flanks (72,73,82,83,62,63) which engage into the guide strips (21–24,31–34).

2. A file according to claim 1, characterised in that on the file back (5) and on the file cover (4) there is arranged at least in each case a stop lug (55,56,45,46), which secures the retaining strips (7,8,6) against unintentional release.

3. A file according to claim 1, characterised in that there are arranged on the file back (5) fourth guide strips (41,42) and on the file cover (4) third guide strips (51,52) for receiving the retaining strips (7,8,6).

4. A file according to claim 1, characterised in that the clamp mechanism (71,81) is arranged on the first retaining strip (7,8).

5. A file according to claim 4, characterised in that the clamp mechanism (71,81) is releasably fastened to the first retaining strip (7,8).

6. A file according to claim 4, characterised in that the clamp mechanism (7,8) comprises clamps in a threesome arrangement or a foursome arrangement.

7. A file according to claim 1, characterised in that the second retaining strip (6) is provided with clamp receivers (617,618).

8. A file according to claim 7, characterised in that the clamp receivers (617,618) for receiving the clamps are arranged in a threesome arrangement as well as a foursome arrangement of the clamp mechanism.

9. A file according to claim 7, characterised in that the second retaining strip (6) comprises two inner clamp receivers (617) and two outer clamp receivers (618), wherein the two inner clamp receivers are arranged for receiving the inner clamps with a foursome arrangement and the two outer clamp receivers for receiving the outer clamps with a threesome arrangement, of the clamps on the clamp mechanism.

10. A file according to claim 4, characterised in that the first retaining strip (7,8) with the clamp mechanism (71, 81) in the region of its upper and lower end in each case comprises a longitudinally displacable hanging-up element (94, 94'), which serves for hanging up the retaining strip (7,8) in a hanging filing cabinet.

11. A file according to claim 10, characterised in that the back section (1) comprises a withdrawable inscription part (14) which with clips (16') may be laterally inserted onto the clamp of the clamp mechanism.

* * * * *

UNITED STATES PATENT AND TRADEMARK OFFICE

CERTIFICATE OF CORRECTION

PATENT NO. : 5,975,576
DATED : November 2, 1999
INVENTOR(S) : Jurgen Vogel

It is certified that error appears in the above-identified patent and that said Letters Patent is hereby corrected as shown below:

On the title page: item number [22] (PCT Filed), should be changed from "Jul. 19, 1996" to -- June 19, 1996 --.

Signed and Sealed this

Seventeenth Day of October, 2000

*Attest:*

Q. TODD DICKINSON

*Attesting Officer*

*Director of Patents and Trademarks*